US006942380B1

(12) United States Patent
Lin

(10) Patent No.: US 6,942,380 B1
(45) Date of Patent: Sep. 13, 2005

(54) KNOCKDOWN FLOOR CLOCK

(75) Inventor: Andy Lin, Taipei (TW)

(73) Assignee: Tsuen Jer Enterprise Co., Ltd., Taipei (TW)

( * ) Notice: Subject to any disclaimer, the term of this patent is extended or adjusted under 35 U.S.C. 154(b) by 1 day.

(21) Appl. No.: 10/903,777

(22) Filed: Aug. 2, 2004

(51) Int. Cl.[7] ..... G04B 37/14
(52) U.S. Cl. ..... 368/276; 368/316; D10/16
(58) Field of Search ..... 368/88, 276, 316–317; D10/1, 16

(56) References Cited

U.S. PATENT DOCUMENTS 215,708 A * 5/1879 Spring ..... 368/276
3,191,901 A * 6/1965 Green ..... 248/116
5,036,501 A * 7/1991 Smith ..... 368/88
6,290,387 B1 * 9/2001 Chen ..... 368/317

* cited by examiner

*Primary Examiner*—Vit W. Miska

(57) ABSTRACT

A knockdown floor clock mainly includes a clock vertically stably supported on a plurality of legs that are radially connected at upper and lower sideward projected heads to upper and lower joining units, respectively. The upper joining unit includes an upper holding tube that is upward extended from a top center of the unit and cooperates with a plurality of curved side supports located at two sides thereof to provide multiple supporting points below the clock. The use of the upper and lower joining units to radially join the legs enables the forming of a knockdown floor clock that can be easily disassembled for convenient storage or firmly assembled for use.

2 Claims, 7 Drawing Sheets

KNOCKDOWN FLOOR CLOCK

FIELD OF THE INVENTION

The present invention relates to a knockdown floor clock, and more particularly to a floor clock that has simple structure for easy assembling and can be easily disassembled for convenient storage and transport.

BACKGROUND OF THE INVENTION

A floor clock mainly includes a plurality of legs supporting a clock thereon. The legs may be differently designed to show unique and beautiful appearances, making the floor clock an important and practical ornament in home design.

In the conventional floor clock, the legs for supporting the clock are mutually connected or connected to the clock by way of welding, bonding, etc. These connecting manners produce a floor clock that could not be disassembled once it is constructed. The fixedly assembled floor clock has big volume and therefore requires large space for warehousing or transporting it that adversely reduces its economical benefits.

It is therefore desirable to develop an improved floor clock that can be easily assembled and disassembled to eliminate the drawbacks existed in the conventional floor clock.

SUMMARY OF THE INVENTION

A primary object of the present invention is to provide an improved knockdown floor clock that mainly includes a plurality of legs that are radially connected at upper and lower projected heads to upper and lower joining units, respectively, so as to stably stand. The upper joining unit includes an upper holding tube that is upward extended from a top center of the unit to support a clock thereon. The use of the upper and lower joining units to join the legs enables the forming of a knockdown floor clock that can be easily assembled to stand stably for use, and easily disassembled to occupy a reduced space for convenient storage or transport thereof, and therefore has increased economic value.

The knockdown floor clock of the present invention is further provided with a plurality of curved side supports connected to two sides of the top of the upper joining unit. The side supports cooperate with the upper holding tube of the upper joining unit to provide multiple supporting points below the clock, so that the knockdown floor clock can stand on a floor in a more stable manner.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
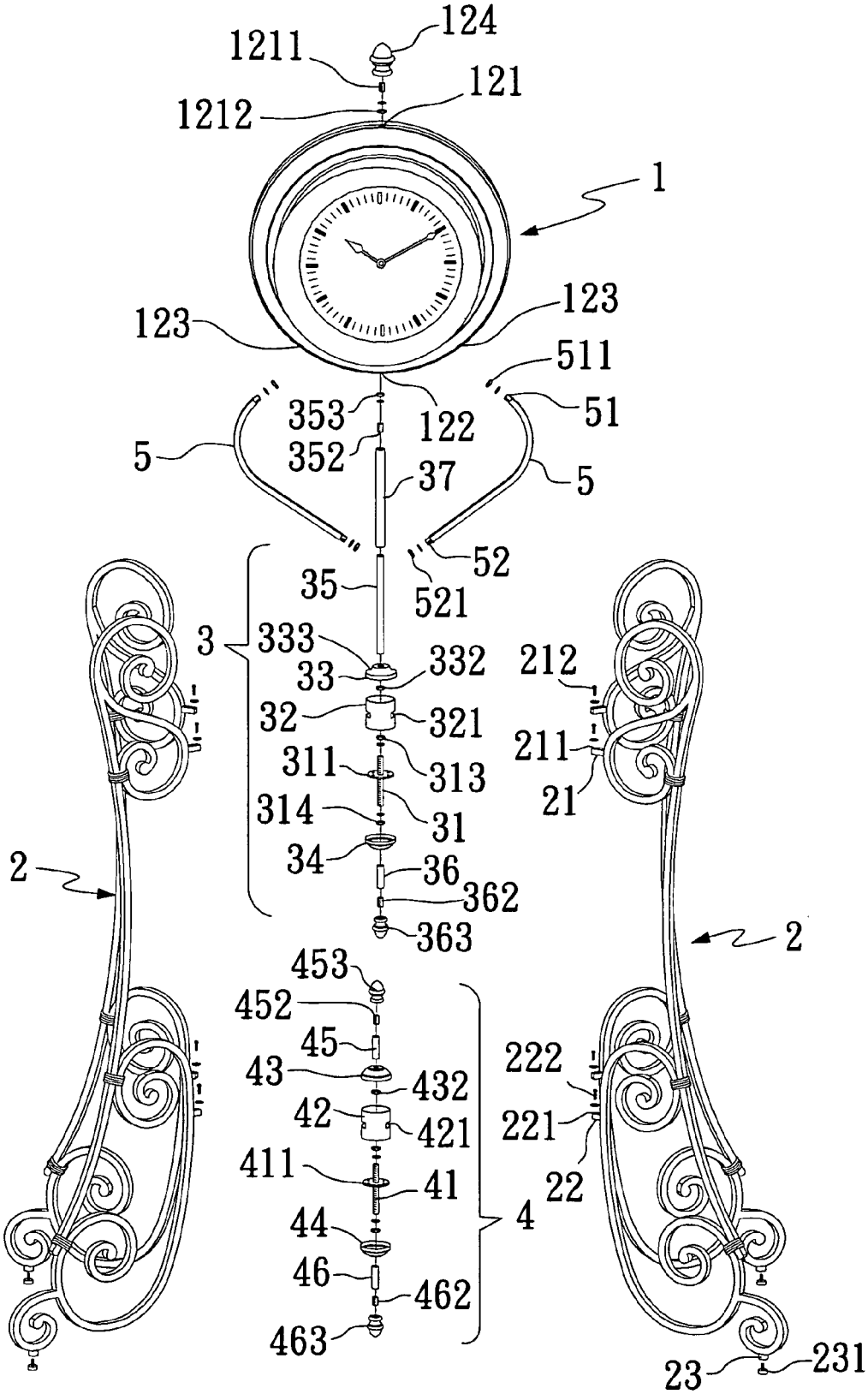
FIG. 1 is an exploded perspective view of a knockdown floor clock according to the present invention.
Figure 4:
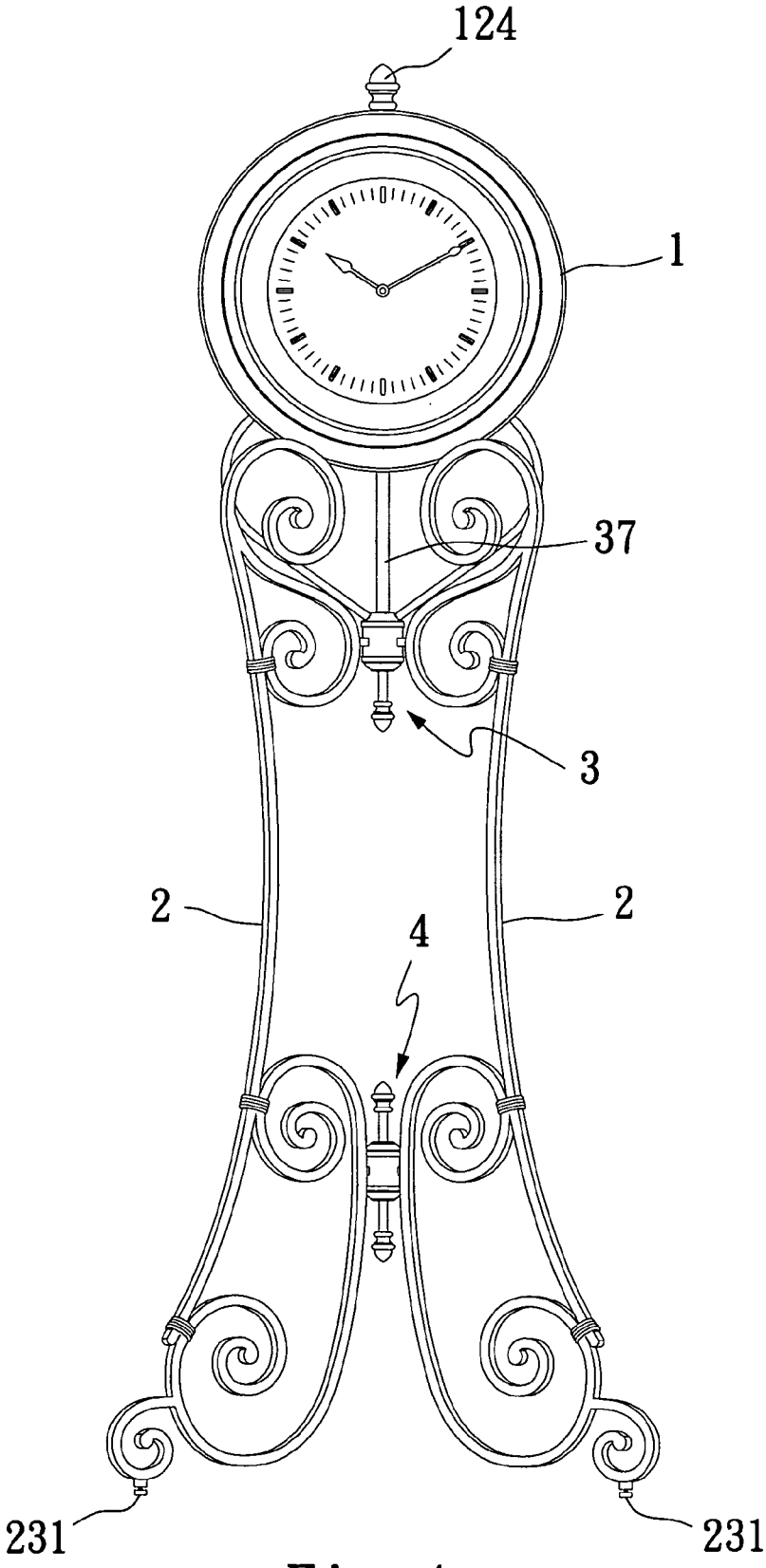
FIG. 4 is an assembled front view of the floor clock of the present invention.
Figure 5:
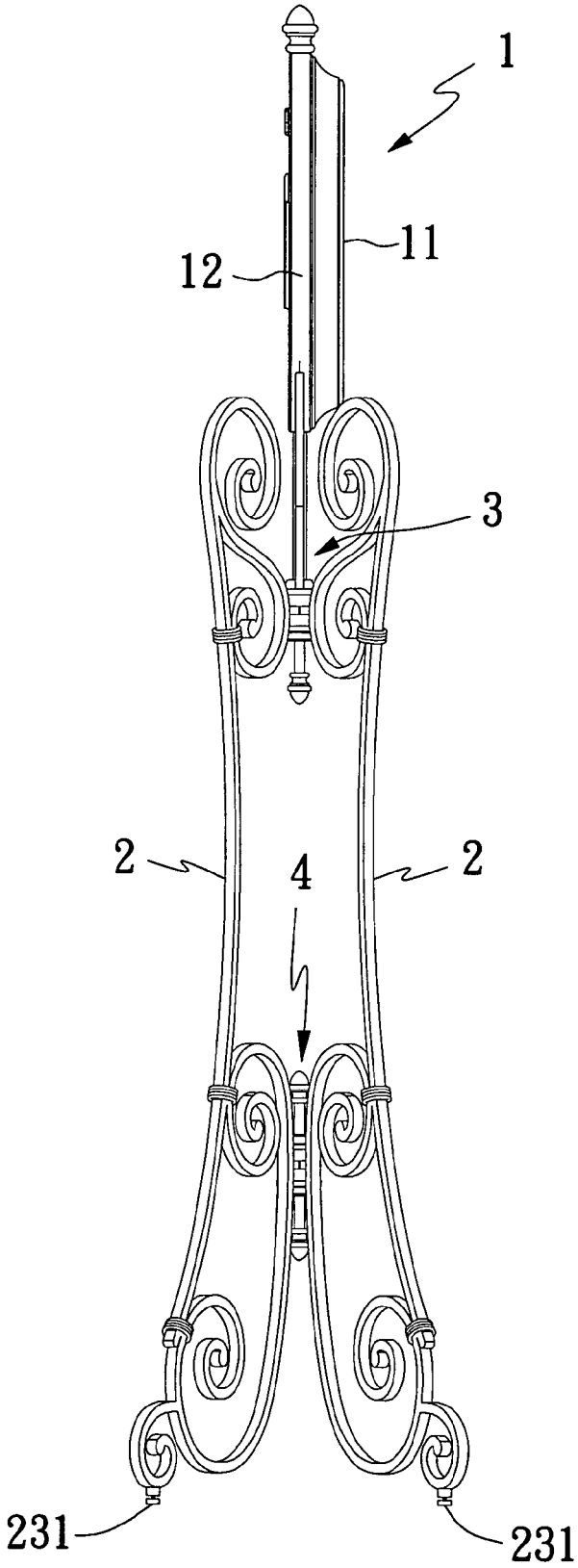
FIG. 5 is an assembled side view of the floor clock of the present invention.

Please refer to FIGS. 1, 4, and 5 which are exploded perspective, assembled front, and assembled side views, respectively, of a knockdown floor clock according to an embodiment of the present invention. As shown, the knockdown floor clock of the present invention mainly includes a clock 1, a plurality of legs 2, an upper joining unit 3, a lower joining unit 4, and a plurality of side supports 5.

The clock 1 includes a clock face 11 and a case 12 framing the clock face 11. The case 12 is provided at an outer periphery with an upper threaded hole 121, a lower threaded hole 122, and a plurality of side holes 123 located at two lateral sides of the lower threaded hole 122. An externally threaded connecting rod 1211 has a lower end screwed into the upper threaded hole 121 and an upper end into a threaded hole preformed at a bottom of an end plug 124, so as to fixedly connect the end plug 124 to a top of the clock 1.

The legs 2 are vertically located below the clock 1. Each of the legs 2 is provided at a middle section with an upper and a lower laterally inward projected head 21, 22, which are provided with a through hole 211, 221, respectively, and at a lower end with a threaded hole 23, into which an adjusting bolt 231 may be screwed by different depths to adjust a supporting height of the leg 2.

Figure 2A:
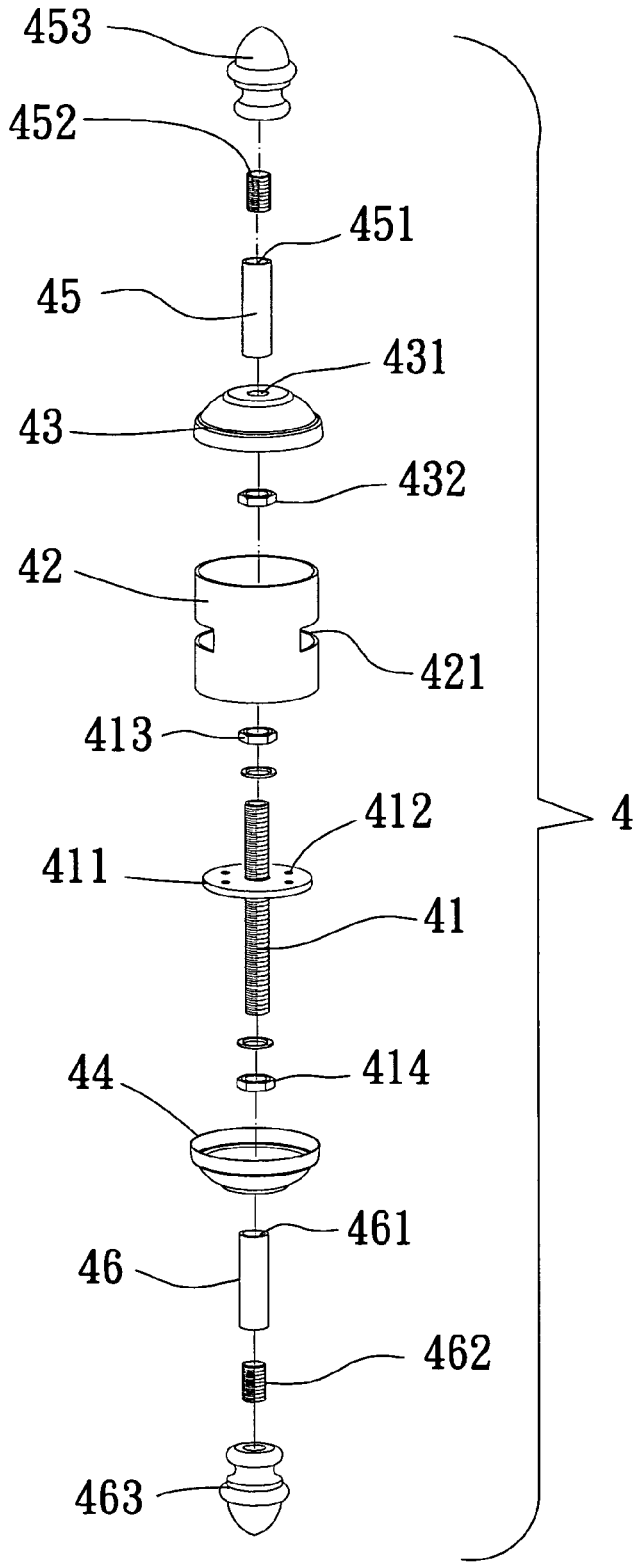
FIG. 2A is an enlarged exploded perspective view of a lower joining unit for the floor clock of the present invention.
Figure 2B:
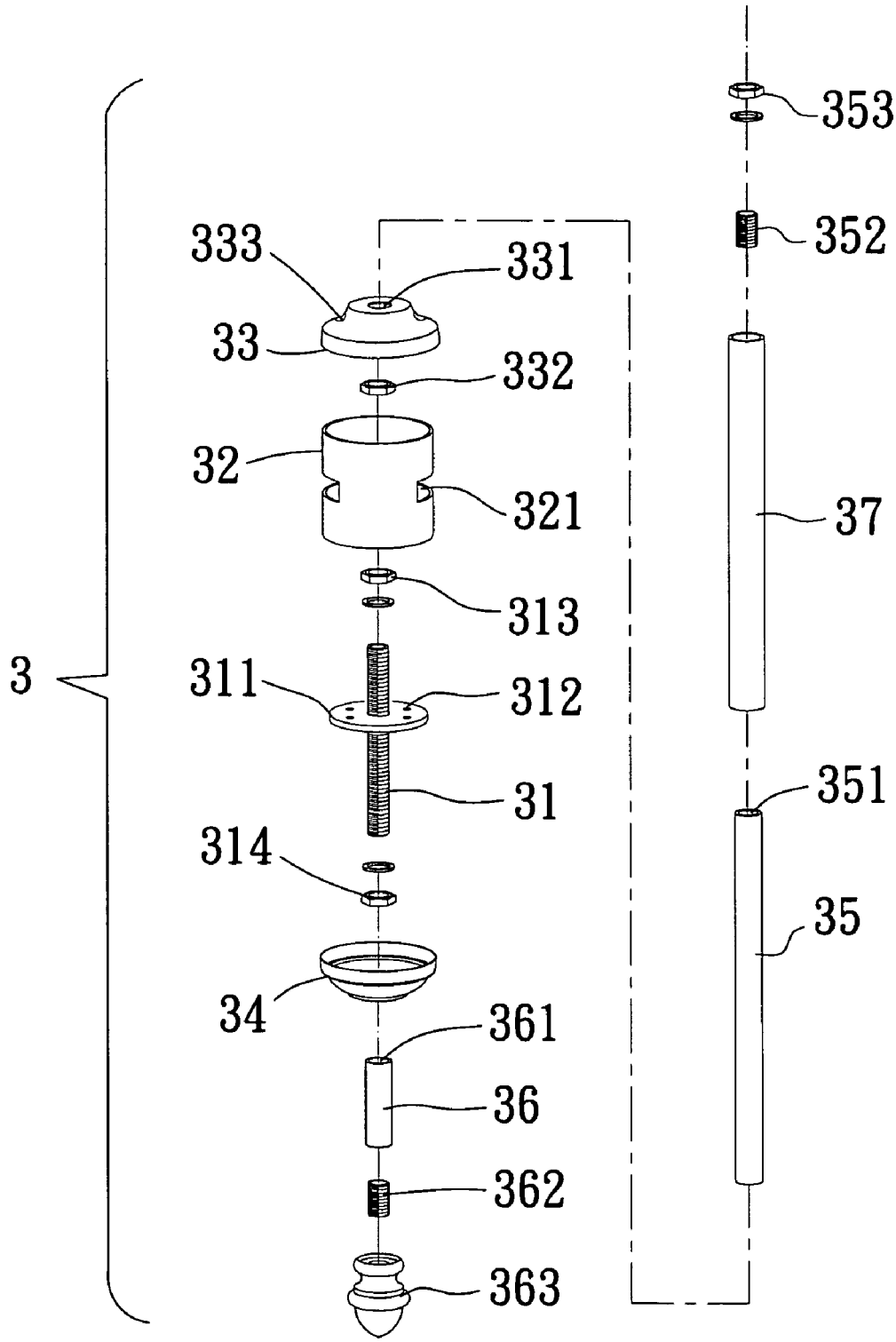
FIG. 2B is an enlarged exploded perspective view of au upper joining unit for the floor clock of the present invention.
Figure 3A:
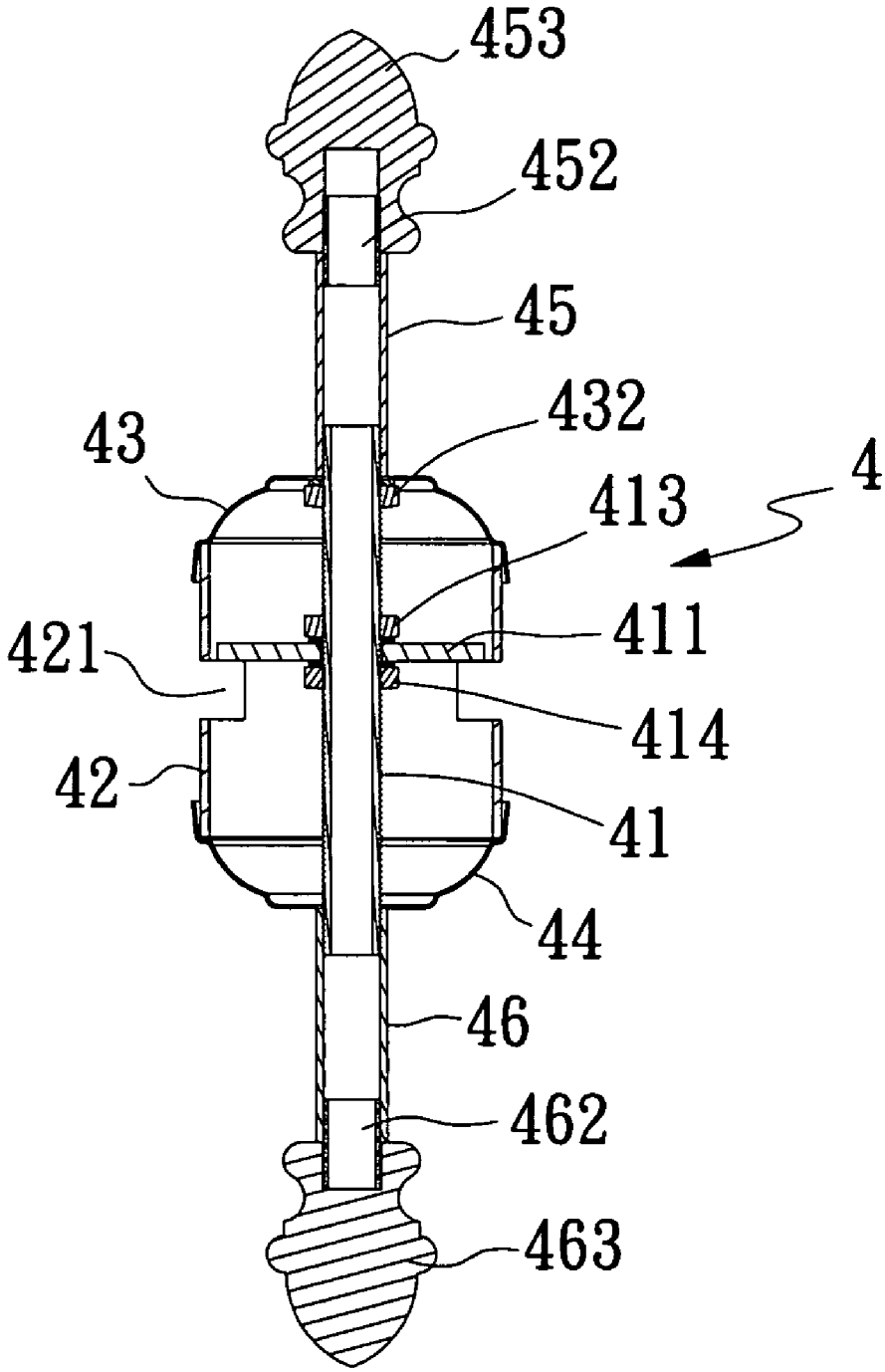
FIG. 3A is an assembled sectional view of the lower joining unit of FIG. 2A.
Figure 3B:
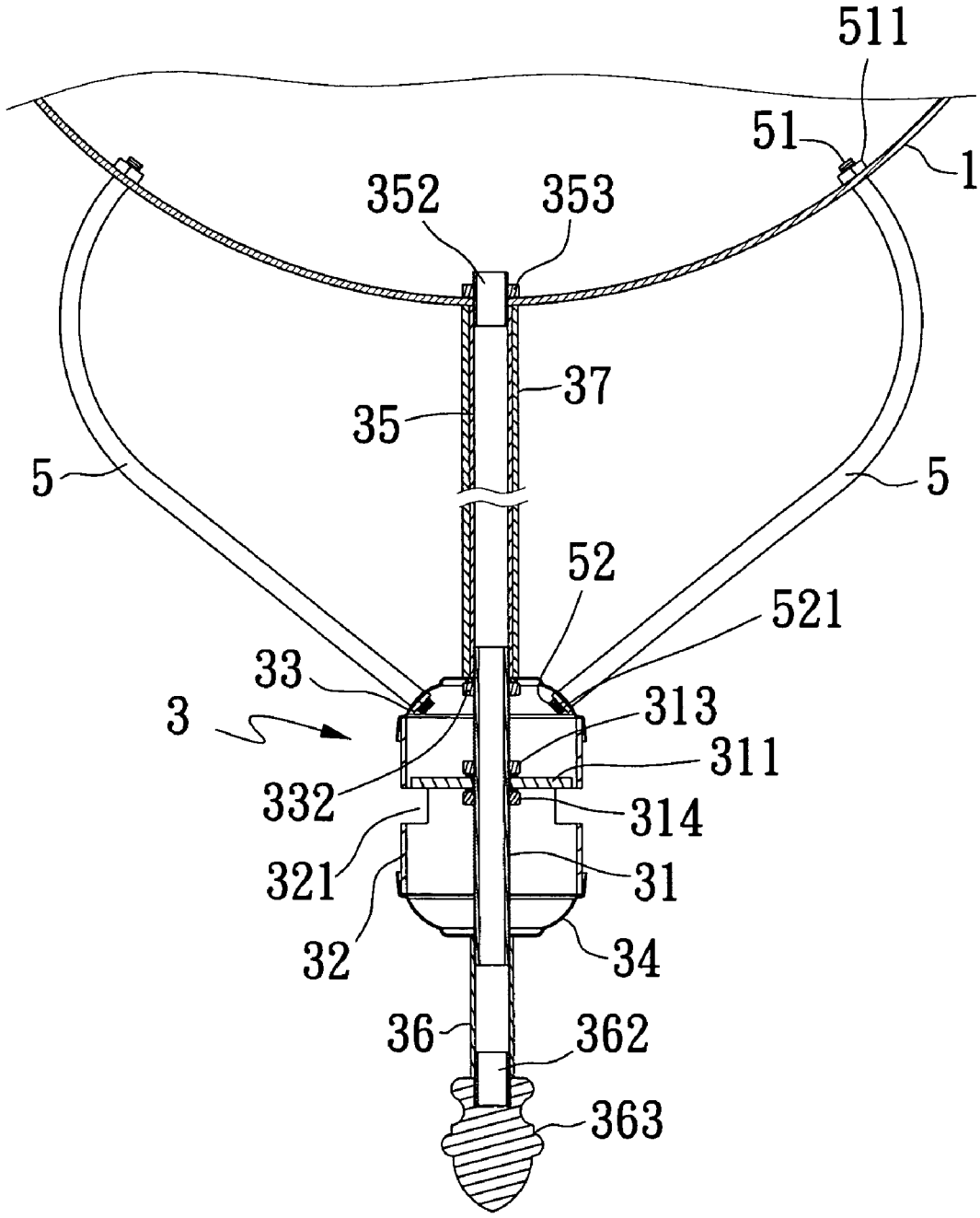
FIG. 3B is an assembled sectional view of the upper joining unit of FIG. 2B.

Please refer to FIGS. 2B and 3B that are enlarged exploded perspective and assembled sectional views, respectively, of the upper joining unit 3. As shown, the upper joining unit 3 includes a main screw rod 31, a joining sleeve 32, an upper cap 33, a lower cap 34, an upper holding tube 35, a lower holding tube 36, and an outer sleeve 37.

The main screw rod 31 is provided at a middle section with a disk 311, which is set to a point on the main screw rod 31 by screwing two nuts 313, 314 to the main screw rod 31 above and below the disk 311. The disk 311 is provided along an outer periphery with spaced threaded holes 312.

The joining sleeve 32 is a hollow cylindrical tube having two diametrically opposite openings 321 formed at a middle section thereof.

The upper cap 33 is for closing an upper end of the joining sleeve 32, and has a centered through hole 331 for the main screw rod 31 to upward extend therethrough and screw into a lower end of an internal threaded hole 351 of the upper holding tube 35. A plurality of side holes 333 are provided closed to an outer periphery of the upper cap 33; and a nut 332 on the main screw rod 31 is screwed to a lower side of the upper cap 33, so as to firmly clamp the upper cap 33 between the nut 332 and the lower end of the upper holding tube 35.

The upper projected head 21 of the leg 2 is adapted to extend into the opening 321 on the joining sleeve 32 and be connected to the outer periphery of the disk 311 by threading a bolt 212 through the through hole 211 on the projected head 21 and the threaded hole 312 on the disk 311.

An upper end of the upper holding tube 35 is connected to a threaded connecting rod 352, which is then extended into the lower threaded hole 122 on the clock 1 and locked thereto with a nut 353.

The outer sleeve 37 is mounted to an outer side of the upper holding tube 35 to serve as a decorative as well as a reinforcing means.

The lower cap 34 is for closing a lower end of the joining sleeve 32 and has a centered through hole for a lower end of the main screw rod 31 to extend therethrough and into an upper end of a threaded hole 361 of the lower holding tube 36. A lower end of the threaded hole 361 of the lower holding tube 36 is screwed to a threaded connecting rod 362, which is then screwed to an end plug 363.

Please refer to FIGS. 2A and 3A that are enlarged exploded perspective and assembled sectional views, respectively, of the lower joining unit 4. As shown, the lower joining unit 4 includes a main screw rod 41, a joining sleeve 42, an upper cap 43, a lower cap 44, an upper holding tube 45, and a lower holding tube 46.

The main screw rod 41 is provided at a middle section with a disk 411, which is set to a point on the main screw rod 41 by screwing two nuts 413, 414 to the main screw rod 41 above and below the disk 411. The disk 411 is provided along an outer periphery with spaced threaded holes 412.

The joining sleeve 42 is a hollow cylindrical tube having two diametrically opposite openings 421 formed at a middle section thereof.

The upper cap 43 is for closing an upper end of the joining sleeve 42, and has a centered through hole 431 for the main screw rod 41 to upward extend therethrough and screw into a lower end of an internal threaded hole 451 of the upper holding tube 45. A nut 432 on the main screw rod 41 is screwed to a lower side of the upper cap 43, so as to firmly clamp the upper cap 43 between the nut 432 and the lower end of the upper holding tube 45.

The lower projected head 22 of the leg 2 is adapted to extend into the opening 421 on the joining sleeve 42 and be connected to the outer periphery of the disk 411 by threading a bolt 222 through the through hole 221 on the projected head 22 and the threaded hole 412 on the disk 411.

An upper end of the upper holding tube 45 is connected to a threaded connecting rod 452, which is then connected to an end plug 453.

The lower cap 44 is for closing a lower end of the joining sleeve 42 and has a centered through hole for a lower end of the main screw rod 41 to extend therethrough and into an upper end of a threaded hole 461 of the lower holding tube 46. A lower end of the threaded hole 461 of the lower holding tube 46 is screwed to a threaded connecting rod 462, which is then screwed to an end plug 463.

With the upper and the lower joining unit 3, 4, the legs 2 can be radially arranged around the two joining units 3, 4 to vertically stably support the clock 1 thereon.

The side supports 5 are curved members, and each of them has two externally threaded upper and lower ends 51, 52. The externally threaded upper ends 51 are upward extended into the side holes 123 of the clock 1, and locked thereto by nuts 511. The externally threaded lower ends 52 are downward extended into the side holes 333 provided on the upper cap 33 of the upper joining unit 3 and locked thereto by nuts 521. With the side supports 5 connected to two lower outer sides of the clock 1, the clock 1 is more securely supported on the legs 2.

When the legs 2 are fully radially extended to support the clock 1 thereon, the adjusting bolt 231 at the lower end of each leg 2 can be screwed into the threaded hole 23 by different depths to adjust an overall supporting height of the leg 2, so that the whole floor clock of the present invention can stably stand on a floor surface.

What is claimed is:

1. A knockdown floor clock, comprising:

a clock having diametrically opposite upper and lower threaded holes provided on an outer periphery thereof, a plurality of side holes located at two lateral sides of said lower threaded hole, and an end plug connected to said upper threaded hole;

an upper joining unit including a main screw rod, a joining sleeve, an upper cap, a lower cap, an upper holding tube, a lower holding tube, and an outer sleeve; said main screw rod being provided at a middle section with a fixed disk, which is provided along an outer periphery with spaced threaded holes; said joining sleeve being a hollow cylindrical tube having two diametrically opposite openings formed at a middle section thereof; said upper cap being closed to an upper end of said joining sleeve and having a centered through hole for said main screw rod to upward extend therethrough and screw into a lower end of a threaded hole of said upper holding tube, said upper cap also being provided closed to an outer periphery with a plurality of side holes, and being firmly clamped to a lower end of said upper holding tube by a nut on said main screw rod below said upper cap; said upper holding tube having an upper end screwed to a threaded connecting rod, which is then extended into said lower threaded hole on said clock and locked thereto with a nut; said lower cap being closed to a lower end of said joining sleeve and having a centered through hole for a lower end of said main screw rod to extend therethrough and into an upper end of a threaded hole of said lower holding tube, while a lower end of said threaded hole of said lower holding tube is connected to an end plug;

a lower joining unit including a main screw rod, a joining sleeve, an upper cap, a lower cap, an upper holding tube, and a lower holding tube; said main screw rod being provided at a middle section with a fixed disk, which is provided along an outer periphery with spaced threaded holes; said joining sleeve being a hollow cylindrical tube having two diametrically opposite openings formed at a middle section thereof; said upper cap being closed to an upper end of said joining sleeve, and having a centered through hole for said main screw rod to upward extend therethrough and screw into a lower end of a threaded hole of said upper holding tube;

said upper cap being firmly clamped to a lower end of said upper holding tube by a nut on said main screw rod below said upper cap; said upper holding tube having an upper end connected to an end plug; said lower cap being closed to a lower end of said joining sleeve and having a centered through hole for a lower end of said main screw rod to extend therethrough and screw into an upper end of a threaded hole of said lower holding tube, while a lower end of said threaded hole of said lower holding tube is connected to an end plug;

a plurality of legs being vertically located below said clock; each of said legs being provided at a middle section with an upper and a lower laterally inward projected head, on each of which a through hole is provided; said upper and said lower projected head on each of said legs being extended into said two opposite openings on said joining sleeves of said upper and said lower joining unit, respectively, and connected to the outer periphery of said disks of said upper and said lower joining unit by threading bolts through said through holes on said upper and lower projected heads of said legs and said threaded holes on said disks of said upper and lower joining units, such that said legs are radially arranged around said upper and lower joining units to support said clock thereon; and a plurality of curved side supports, each of which has two externally threaded upper and lower ends; said externally threaded upper ends being upward extended into said side holes of said clock and locked thereto by nuts; and said externally threaded lower ends being downward extended into said side holes provided on said upper cap of said upper joining unit and locked thereto by nuts, such that said side supports are connected to two lower outer sides of said clock to more securely support said clock on said legs.

2. The knockdown floor clock as claimed in claim 1, wherein each of said legs is provided at a lower end with an internally threaded hole for an adjusting bolt to screw thereinto, whereby when said adjusting bolts are separately screwed into said threaded holes at the lower end of said legs by different depths to adjust a supporting height of said legs to match a floor on which the floor clock stands, said floor clock can be stably supported on the floor.

* * * * *